United States Patent [19]

Nichols et al.

[11] 4,349,791

[45] Sep. 14, 1982

[54] SLOW WAVE COUPLING CIRCUIT

[75] Inventors: Lawrence J. Nichols, Burlington; George H. MacMaster, Lexington, both of Mass.

[73] Assignee: Raytheon Company, Lexington, Mass.

[21] Appl. No.: 180,221

[22] Filed: Aug. 21, 1980

Related U.S. Application Data

[63] Continuation of Ser. No. 967,811, Dec. 8, 1978, abandoned.

[51] Int. Cl.[3] ..... H01P 1/18; H01P 5/04; H01P 9/02; H01P 9/04

[52] U.S. Cl. ..... 333/27; 333/156; 333/162; 333/203

[58] Field of Search ..... 333/24 R, 27, 156–157, 333/161–163, 245, 248, 203; 315/3.5, 3.6, 39.3

[56] References Cited

U.S. PATENT DOCUMENTS 2,823,333 2/1958 Quate ..... 333/157 X
3,980,920 9/1976 Dudley et al. ..... 315/39.3

*Primary Examiner*—Marvin L. Nussbaum
*Attorney, Agent, or Firm*—Martin M. Santa; Joseph D. Pannone

[57] ABSTRACT

A system of slow wave structures for coupling a first electromagnetic circuit to a second electromagnetic circuit includes an inner slow wave structure and an outer slow wave structure concentric with the inner structure. The outer structure is configured to provide for a greater phase velocity of electromagnetc waves than the inner structure, the phase velocities for each structure being proportional to the circumference of each structure so that the rate of circulation of a wavefront about the common axis of the two structures is the same for a wave propagating about the inner structure and a wave propagating about the outer structure. The structures are terminated in their characteristic impedances to provide for wave propagation in one direction without reflections.

22 Claims, 14 Drawing Figures

SLOW WAVE COUPLING CIRCUIT

CROSS-REFERENCE TO RELATED CASES

This is a continuation of application Ser. No. 967,811, filed Dec. 8, 1978 now abandoned.

BACKGROUND OF THE INVENTION

The invention relates to a circuit for coupling a signal of electromagnetic energy between a first circuit and a second circuit and, more particularly, for simulating the effect of a slow wave device such as a crossed field amplifier upon a signal.

Devices employing slow wave structures are utilized in radar as well as communication systems for amplifying signals, such devices including crossed field amplifiers and traveling wave tubes. Such slow wave devices tend to modify the signal as by introducing a phase shift and amplitude shift as a function of frequency. The foregoing modification of the signal varies with aging of the crossed field amplifiers and traveling wave tubes.

To correct for the foregoing modifications of the signal, it is desirable to have a reference channel wherein a reference signal is made available to the radar signal processing equipment. However, in the past, such reference signals have often been obtained by extracting a sample of the output signal from the slow wave device. However, the effect of aging, associated with decreased electron emission from a cathode of a crossed field amplifier or traveling wave tube goes undetected in the reference signal in the foregoing example wherein the reference signal is obtained at the output port of the slow wave device. When the signal is obtained prior to the input port of the slow wave device, the reference signal does not show any effects of the foregoing modification of the signal. Thus, no data is available as to the effect of aging of the slow wave device, and no corrective action can be taken by a radar signal processor to compensate for the aging effect on the signal produced by the slow wave device.

SUMMARY OF THE INVENTION

The aforementioned problem is overcome and other advantages are provided by a slow wave coupling circuit which comprises a plurality of slow wave structures for simulating the coupling of electromagnetic energy which occurs in the slow wave structures of crossed field amplifiers and traveling wave tubes. In accordance with the invention, the coupling circuit includes an inner slow wave structure and an outer slow wave structure concentric therewith. The outer structure is configured to provide for a greater phase velocity of electromagnetic energy than the inner structure, the speed of propagation for each structure being proportional to the circumferences of the respective structures so that the rate of circulation of a wavefront about the common axis of the two structures is the same for waves propagating about the inner structure and the outer structure.

The inner structure has two ports, one port serving as an input port to be coupled to an input signal from the first electromagnetic circuit while the second port is coupled to a load matched to the characteristic impedance of the inner structure. The matched load insures the propagation of a wave in one direction without reflections and the attendant presence of a standing wave or a resonance. Similarly, the outer structure is provided with two ports one of which is terminated in a matched load and the second of which serves as an output terminal for coupling an output signal to the second electromagnetic circuit. The matched load of the outer structure provides for the propagation of a wave in one direction without reflections and the attendant presence of a standing wave or a resonance. The slow waves of the inner and outer structures circulate about the axis in the same direction. Minimal coupling and maximum attenuation are attained between a signal at the input terminal and a signal at the output terminal under the foregoing conditions wherein no standing waves are present.

In a preferred embodiment of the invention, both slow wave structures have a generally cylindrical shape. The two structures are spaced apart without electrical contact to provide the desired attenuation and isolation. The inner slow wave structure is constructed in the format of an interdigital line while the outer slow wave structure has the form of a strapped bar line. Means are disclosed for altering the relative positions of elements of the interdigital line to accomplish a change in capacitance of the line for varying the phase velocity of the slow wave. This permits a precise alignment of the phase velocity of the wave of the inner structure with the phase velocity of the wave on the outer structure. The spacing between the two structures is approximately equal to the width of a member of the interdigital line to give an attenuation of approximately 30 db (decibels). The diameter of the outer structure is typically one foot (30 centimeters) at a signal frequency of approximately 900 MHz (megahertz).

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 6:
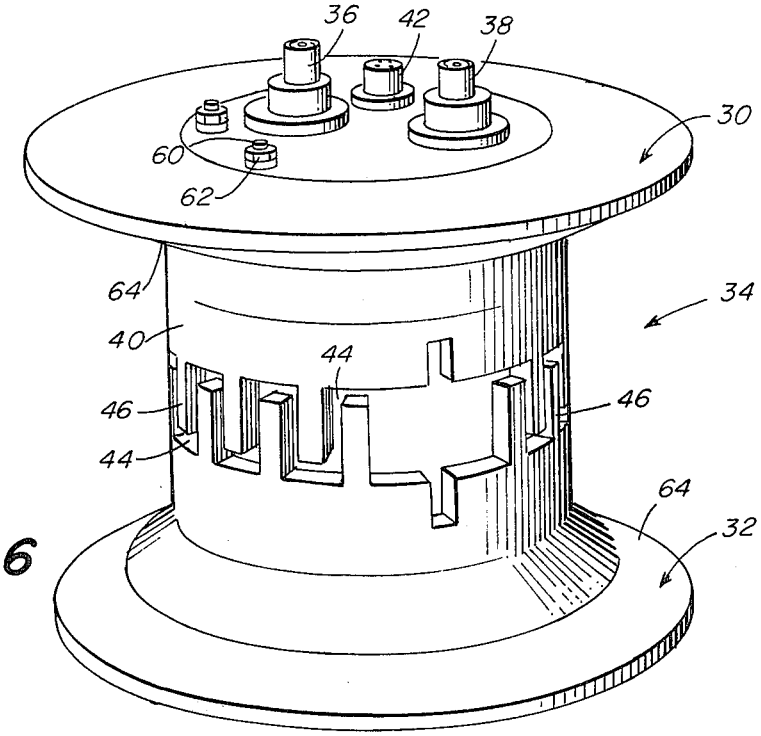
FIG. 6 shows an inner assembly including an inner slow wave structure of the coupling circuit of FIG. 1, the structure having the form of an interdigital line.

Referring now to FIGS. 1–4, there is seen a coupling circuit 20 for the coupling of electromagnetic energy in accordance with the invention. The coupling circuit 20 comprises a cylindrical housing 22 having first and second ports 24 and 26 thereon for the coupling of electromagnetic energy to an outer slow wave structure 28 affixed to the interior of the housing 22. Referring also to FIG. 6, upper and lower cover plates 30 and 32 secure an inner slow wave assembly 34 at the center of the housing 22. The upper cover plate 30 is provided with first and second ports 36 and 38 for coupling electromagnetic energy to an inner slow wave structure 40 of the assembly 34. A terminal 42 is also provided in the upper cover plate 30 for use in an alternative embodiment of the circuit 20, as will be described hereinafter, for coupling electrical signals to control the size of a gap 44 between interdigital members 46 of the inner slow wave structure 40.

The outer slow wave structure 28 comprises upper and lower conductors 48 and 50 positioned circumferentially along the interior of the housing 22, a first end of the conductor 48 and of the conductor 50 serving as one terminal of the slow wave structure while a second end of the conductor 48 and of the conductor 50 serves as a second terminal of the slow wave structure 28. The first and second terminals of the structure are coupled respectively to the ports 24 and 26 as shown schematically in FIG. 3. The conductors 48 and 50 provide a line along which a wave is guided, the line being loaded by transverse bars 52 of which opposite ends are alternately mounted by pedestals 54 to the conductors 48 and 50, the bars 52 providing a periodic loading of the line to slow down the phase velocity of a wave traveling along the line. The upper and lower ends of each of the bars 52 are bent over and secured to upper and lower rims 56 and 58 of the housing 22. The width of each bar 52 is approximately equal to the spacing between the bars 52.

By way of example, in the construction of the coupling circuit 20 for electromagnetic waves having a frequency of approximately 900 megahertz, the diameter of the outer slow wave structure 28 is approximately one foot (30 centimeters), and each of the bars 52 has a length of approximately one-half wavelength between the pedestals 54. The outer slow wave structure 28 is fabricated of an electrically conducting material such as copper. Details in the construction of such strapped bar lines as well as of the interdigital inner slow wave structure 40 are described in a book entitled "Microwave Filters, Impedance-Matching Networks, and Coupling Structures" by G. L. Matthaei, L. Young and E. M. Jones published by McGraw-Hill Company in 1964. For example, an interdigital line is described on page 621 thereof. The operation of a slow wave structure may be explained by reference to the graph of FIG. 4 wherein the vertical axis is in terms of radian frequency, $\omega$, and the horizontal axis is is terms of wave number, $\beta$, designating phase shift per pitch, the pitch being the distance between successive bars 52. The graph shows that the wave propagating along the structure 28 is a backward wave. The phase shift between successive bars 52 is approximately 150° at the operating frequency. In an embodiment of the invention which has been built, twenty-three bars 52 were utilized in constructing the coupling circuit 20.

Figure 5:
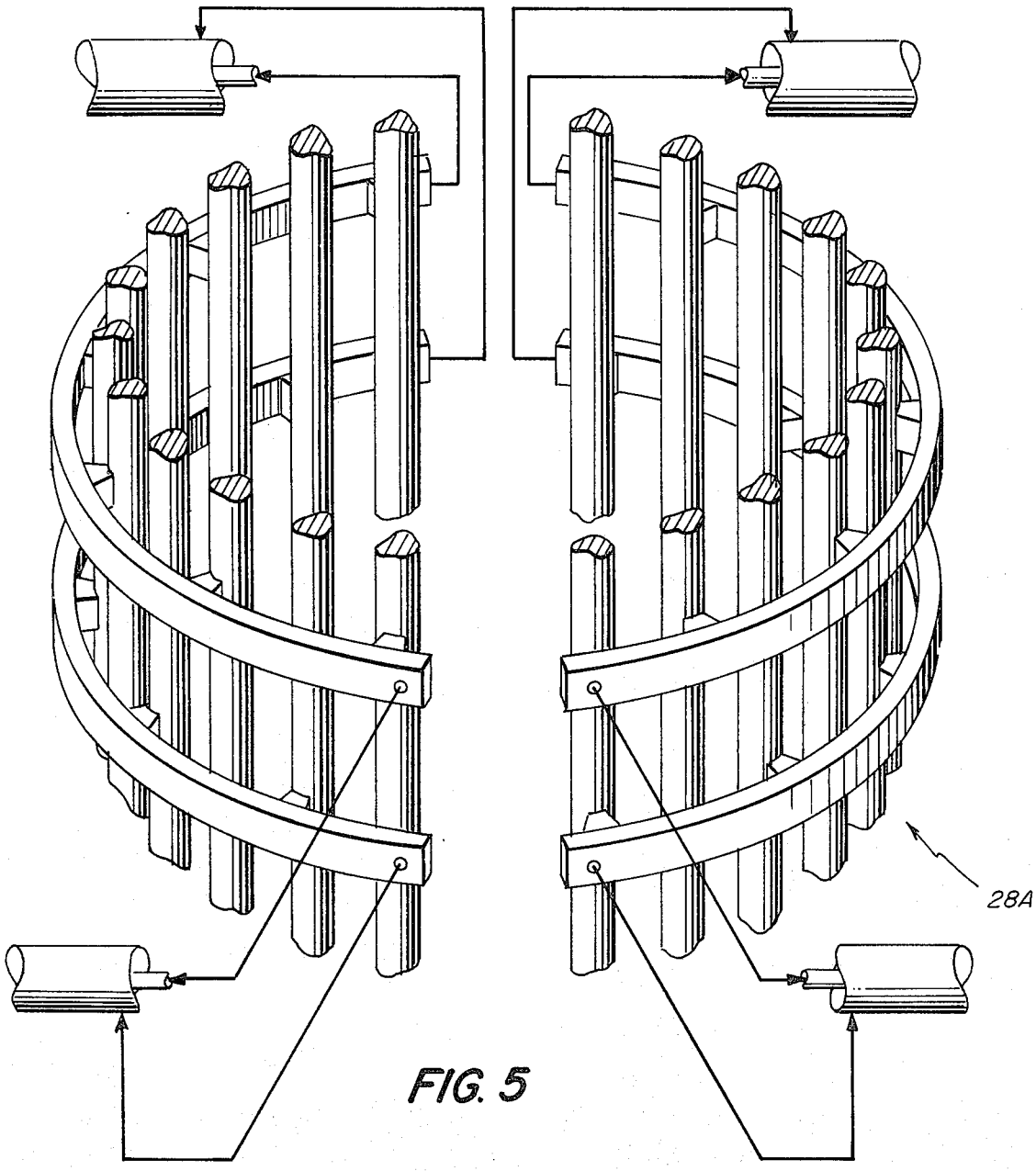
FIG. 5 shows a slow wave structure fabricated in the manner of that shown in FIG. 3 but being modified to provide two input ports and two output ports.

Referring now to FIG. 5, there is seen an alternative embodiment of the outer slow wave structure 28, this alternative embodiment being identified by the legend 28A. The structure 28A is bifurcated and is composed of strapped bar lines for coupling to two sets of ports. Each of the bar lines extends approximately half way around the circumference of the inner surface of a housing such as the housing 22 to permit the coupling of electromagnetic energy from the inner slow wave structure 40 of FIG. 6 to each section of a bifurcated slow wave structure rather than to a slow wave structure such as a structure 28 having but one pair of terminals. Additional ports (not shown) such as the ports 24 and 26 are to be provided on the housing 22 when the structure 28A of FIG. 5 is utilized.

Referring now to FIG. 6, the inner slow wave assembly 34 is seen to complete the aforementioned cover plates 30 and 32, and the inner slow wave structure 40. The cover plates 30 and 32 are secured respectively to the top and bottom edges of the inner slow wave structure 40 by bolts 60 which pass through both of the plates 30 and 32 and are secured by nuts 62. Both the inner slow wave structure 40 and the outer slow wave structure 28 of FIG. 1 have a cylindrical form with the outer diameter of the inner slow wave structure 40 being less than the inner diameter of the outer slow wave structure 28 to permit the placement of the structure 40 within the structure 28. The spacing between the two structures 40 and 28 is approximately equal to the width of a bar 52 of the outer slow wave structure 28. The plates 30 and 32 are provided with flanges 64 for nesting within the upper and lower rims 56 and 58 of the housing 22 of FIG. 2.

Figure 4:
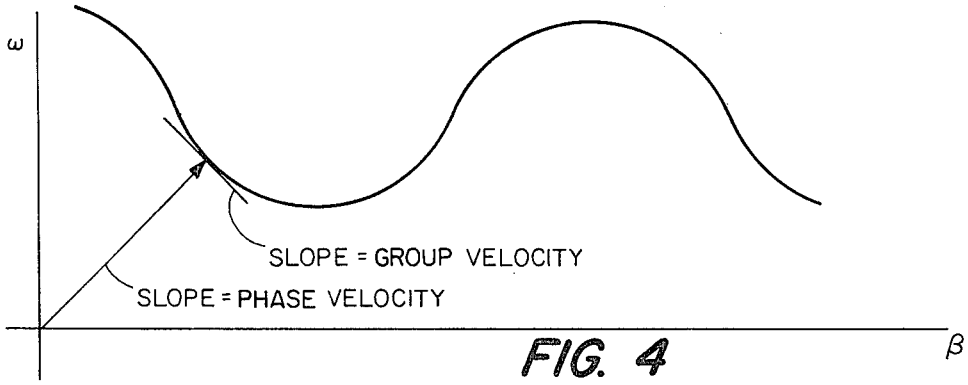
FIG. 4 shows a graph of frequency versus wave number for explaining the operation of wave propagation about the slow wave structures of the invention.
Figure 7:
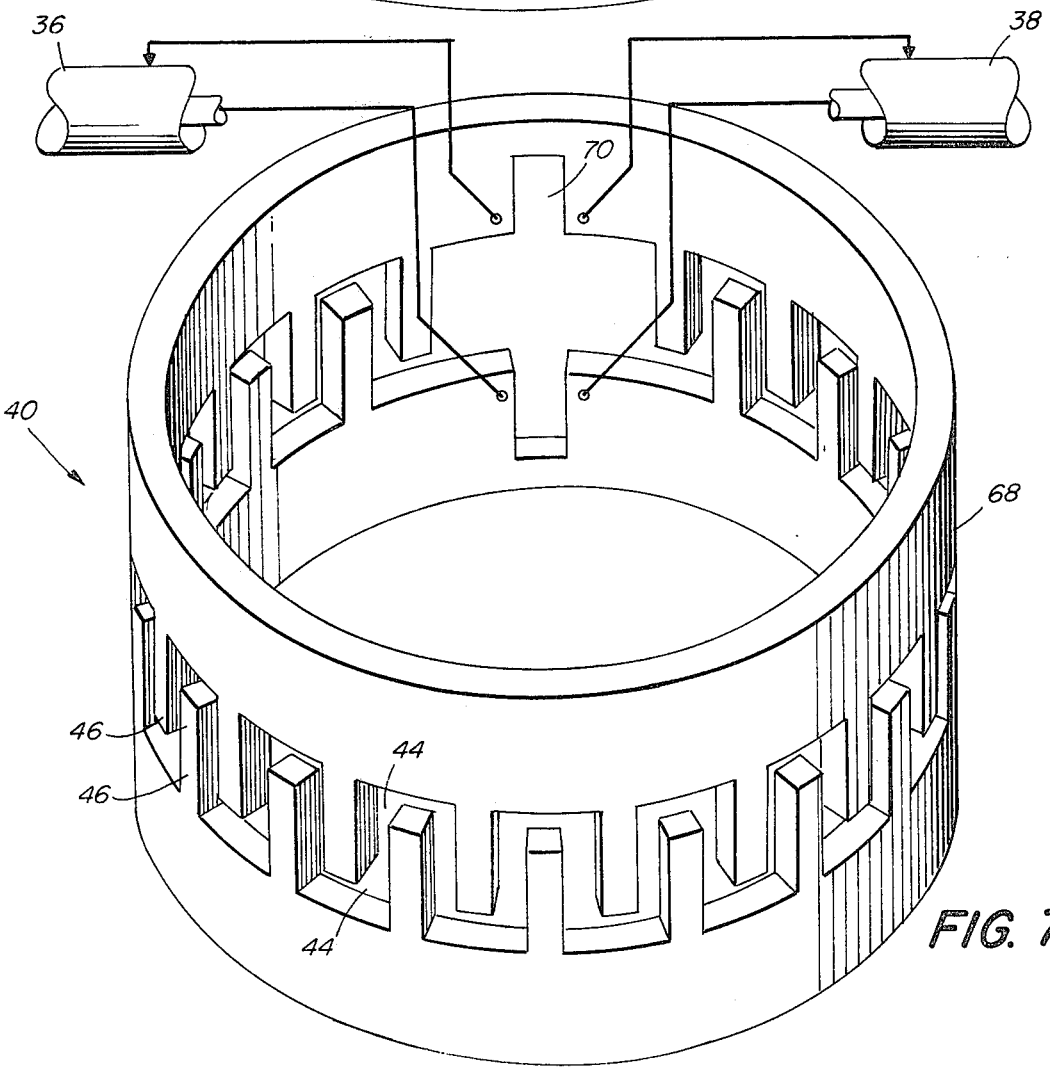
FIG. 7 shows an isometric view of the inner slow wave structure of FIG. 6 with electrical connections from the input and output terminals thereof to coaxial cables being shown schematically.

Referring also to FIG. 7, there is seen an isometric view of the inner slow wave structure 40, the structure 40 having a cylindrical format with the central portion of the structure 40 comprising an interdigital line cut into a cylindrical wall 68 to produce the aforementioned members 46 spaced apart by the gap 44. The graph of FIG. 4 also applied to the structure 40, the structure 40 supporting a slow wave propagating in the backward mode. A slot 70 defines first and second ends of the interdigital line which are coupled respectively to the coaxial lines of the first port 36 and the second port 38. The operating point on the graph of FIG. 4 provides for a phase shift of approximately 150° between succeeding members 46 of the interdigital line. The structure 40 as well as the upper and lower plates 30 and 32 are fabricated of an electrically conducting material such as copper. As can be seen in FIG. 7, the perforation of the gap 44 progresses completely around the wall 68 to the slot 70 thereby dividing the wall 68 into upper and lower sections. The upper section is secured to the upper cover plate 30 and the lower section secured to the lower cover plate 32 by a press fit along a mating surface on the respective plates 30 and 32. The bolts 60, by securing the plates 30 and 32 in intermediate contact with the housing 22, provide for maintaining the desired width of the gap 44. The speed of propagation of the slow wave about the interdigital line is dependent of the capacitance between the terminal of the members 46 and the wall 68.

Figure 8:
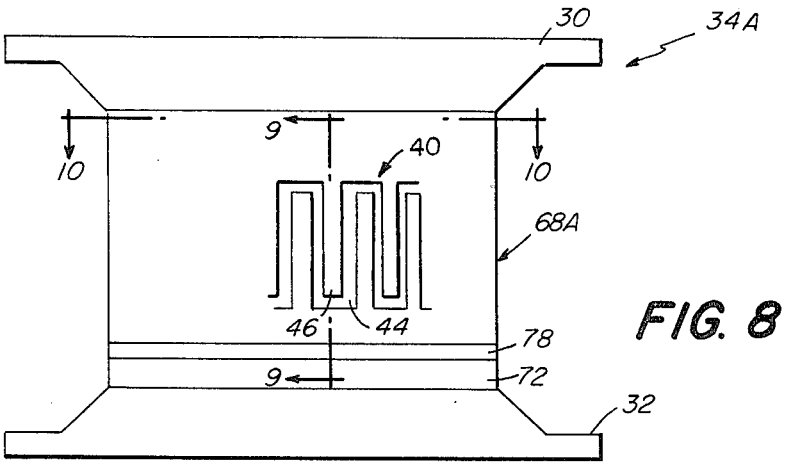
FIG. 8 shows an elevation view of an alternative embodiment of the inner slow wave structure of FIG. 7, this embodiment providing for a variation in the gap size between portions of the interdigital structure to permit a variation in the speed of propagation of a wavefront around the slow wave structure.
Figure 10:
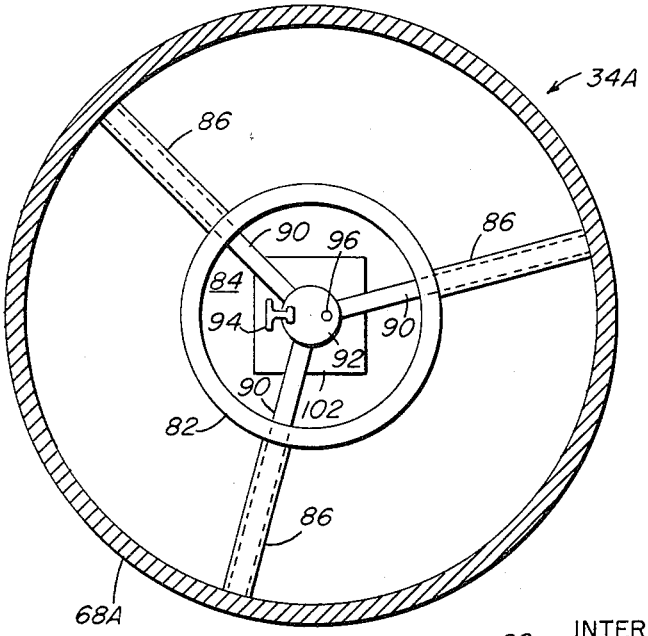
FIG. 10 is a plan view of the structure of FIG. 8 taken along the lines 10—10 of FIG. 8.
Figure 9:
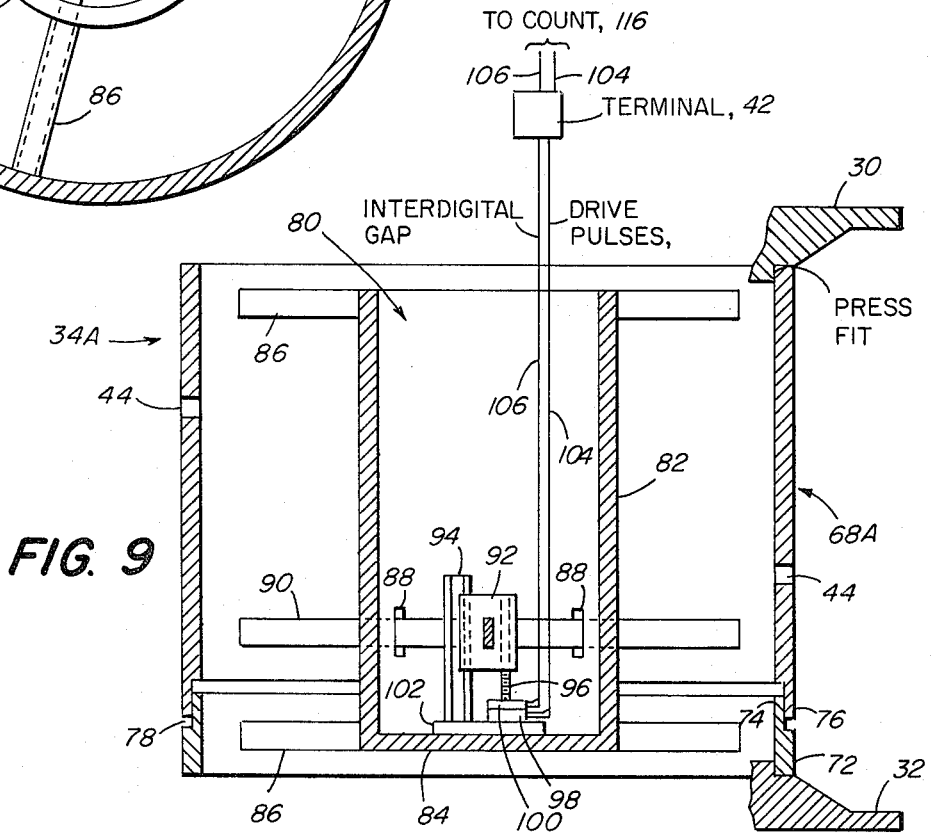
FIG. 9 is a sectional view of the structure of FIG. 8 taken along the lines 9—9 of FIG. 8, FIG. 9 also showing an electric motor for adjusting the gap size, the electrical connection to the motor and to a shaft angle encoder being shown schematically.

Referring now to FIGS. 8, 9 and 10, there is shown an alternative embodiment of the inner slow wave assembly, this embodiment being identified by the legend 34A. The cover plates 30 and 32 have been deleted in FIGS. 9 and 10 to simplify the drawings. A wall 68A is provided with a sleeve 72 having an overlapping edge 74 which slidably nests within an edge 76 of the lower portion of the wall 68A. A channel 78 circumscribing the wall 68A permits a vertical displacement of the lower portion of the wall 68A while the upper portion of the wall 68A remains rigidly secured to the upper cover plate 30 and the sleeve 72 remains rigidly secured to the lower cover plate 32. By vertically displacing the lower portion of the wall 68A, the members 46 of the lower portion of the wall 68A move past the members 46 of the upper section of the wall 68A thereby altering the width of the gap 44. Since the capacitance between the termini of the members 46 and the wall 68A are dependent of the width of the gap 44, the sliding of the lower portion of the wall 68A along the sleeve 72 permits adjustment of the capacitance and thereby a selection of the speed of propagation of a wavefront of the slow wave about the inner slow wave structure 40. Such adjustment is useful for equalizing the rate of circulation of a wavefront about the inner slow wave structure with the rate of circulation of a wavefront about the outer slow wave structure 28.

A mechanical supporting structure, to be referred to hereinafter as a spider 80, positions the upper portion of the wall 68A, the lower portion of the wall 68A and the sleeve 72 relative to each other. The spider 80 comprises a cylindrical wall 82 with a floor 84 at the bottom end thereof, the wall 82 having legs 86 extending outwardly therefrom contacting the upper section of the wall 68A and the sleeve 72. The wall 82 is also provided with slots 88 through which legs 90 are directed from a central block 92 to the lower portion of the wall 68A. The block 92 is slidably positioned along a rail 94 by a worm drive 96 rotated by a motor 98 with the amount of angular rotation of the drive 96 being monitored by a shaft angle encoder 100. The rail 94 is secured by a boss 102 to the floor 84. By way of example, the motor 98 may be a stepping motor with electrical drive pulses being provided thereto along the electric wires shown schematically as line 104 for driving the motor 98 clockwise or counterclockwise. Electric signals designating the angle of rotation of the drive 96 are transmitted by the encoder 100 via line 106. Rotation of the worm drive 96 advances the position of the block 92 and thereby alters the position of the lower portion of the wall 68A relative to the upper portion of the wall 68A and to adjust the gap 44 of the interdigital line. Accordingly, the signal on line 106 also represents the width of the gap 44.

Returning to FIG. 1, the coupling circuit 20 is operated as follows. A source of signal, such as a signal generator 108 is coupled to the first port 36 while a load 110 which is matched to the characteristic impedance of the inner slow wave structure 40 is coupled to the second port 38 on the upper cover plate 30. A second load 112 which is matched to the characteristic impedance of the outer slow wave structure 28 is coupled to the first port 24 on the housing 22 while the second port 26 is coupled to a utilization device 114. With reference also to FIGS. 2 and 6, the signal from the generator 108 is coupled via the port 36 to the first end of the interdigital line, and proceeds to travel as a slow wave around the inner slow wave structure 40. Upon reaching the second end of the interdigital line, the signal is coupled via the second port 38 to the matched load 110. Absorption of the signal in the matched load 110 insures that there are substantially no reflections of a wave from the second end of the interdigital line. As a result, the strength of the electric field is maintained at substantially lower values along the inner slow wave structure 40 than would be the case if the interdigital line were not terminated by the matched load in which case the standing wave due to reflections at the ends of the line would appear. Such standing waves have substantially increased values of electric field strength. Due to the relatively small amount of electric field strength obtained by terminating the line in its characteristic impedance, the inner and outer structures 40 and 28 are partially isolated electrically from each other so that the coupling is consistently maintained at a steady value independently of the utilization device. In a preferred embodiment of the invention, one-thousandths of the input power, −30 dB (decibels), is coupled to the utilization device.

In a similar manner, a wave induced on the outer slow wave structure 28 by the coupling from the inner slow wave structure propagates around the outer slow wave structure 28 without reflection at the end thereof due to the presence of a matched load 112. The wave on the inner structure 40 and the wave on the outer structure 28 propagate in the same direction about the common axis of the two structures 40 and 28. Preferably, the generator 108 and the utilization device 114 each have an impedance equal to the characteristic impedance of their respective slow wve structures 40 and 28 to insure minimal reflections of waves at the terminals of the respective slow wave structures.

Figure 11:
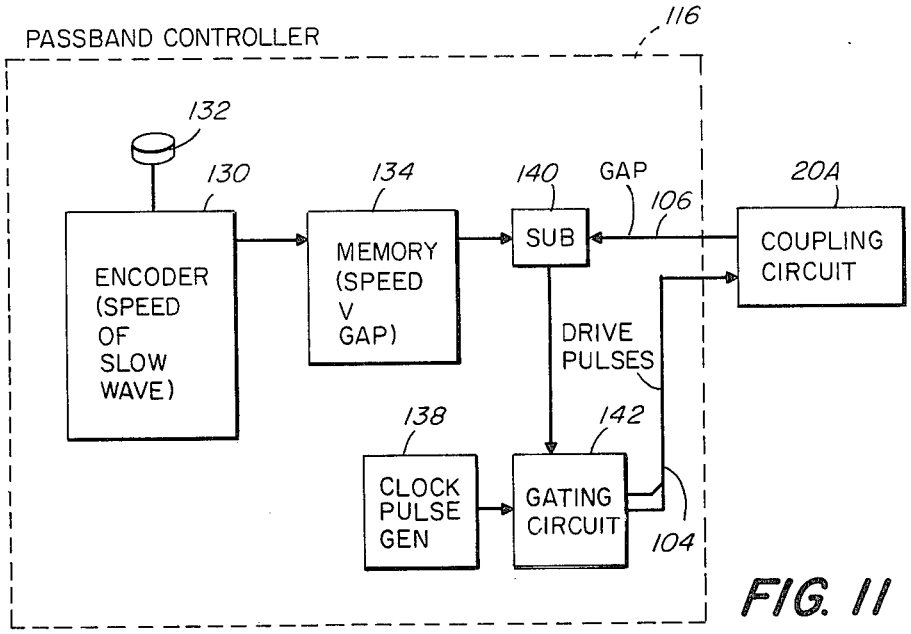
FIG. 11 shows a block diagram of a pass band controller shown connected to the coupling circuit of FIG. 1, FIG. 11 further showing circuitry for activating the motor of FIG. 9.

In the event that the alternative embodiment of the inner slow wave assembly 34A of FIGS. 8–10 is utilized, a pass band controller 116, as will be described hereinafter with reference to FIG. 11, is coupled via the terminal 42 of FIGS. 1, 6 and 9 and the lines 104 and 106 to the motor 98 and the encoder 100 for adjusting the gap 44 of the inner slow wave structure 40. The coupling circuit 20 is responsive to the frequency of the signal provided by the generator 108 and provides a maximum amplitude of output signal to the utilization device 114 at that frequency. The bandwidth of the coupling circuit 20 is dependent on the bandwidth of the inner slow wave structure 40 and the bandwidth of the outer slow wave structure 28, these bandwidths being dependent on design criteria such as that of the frequency versus wave number relationship of FIG. 4. Such bandwidth critera are also described in the aforementioned book by Matthaei et al. A variation in the size of the gap 44 of the inner slow wave structure 40 alters the propagation speed of a wave around the structure 40 and also alters the pass band thereof. The pass band controller 116, by controlling the size of the gap 44, as will be described subsequently with reference to FIG. 11, thereby controls the pass band of the coupling circuit 20.

Referring now to FIG. 11, there is seen a block diagram of the pass band controller 116 connected to a coupling circuit 20A, the legend 20A indicating the coupling circuit is employing the inner slow wave assembly 34A of FIGS. 8–10. The controller 116 is seen to comprise an encoder 130 ahving a knob 132 thereon for manually setting a desired size of the gap 44, a memory 134 a clock pulse generator 138, a substractor 140, and a gating circuit 142.

The controller 116 operates as follows. The desired speed of the propagation around the inner slow wave structure 40 is selected by the encoder 132, the knob 130 attached thereto permitting manual selection of the propagation speed. For each value of speed, there is a corresponding magnitude of the gap 44 as is known from the design of interdigital lines as is explained in the aforementioned book of Matthale. The corresponding values of magnitude of the gap 44 are stored in the memory 134 and are addressed by signals from the encoder 130 representing the desired speed. The actual gap width as communicated via line 106 is compared with the required gap width of the memory 134 in the substractor 140. The substractor 140 forms the difference between the required gap width and the actual gap width, the difference appearing on line 148. The signal on line 148 includes a sign bit which indicates whether the actual gap width is larger or smaller than the required gap width. In response to the sign bit on line 148, the gating circuit 142 couples clock pulses from the generator 138 to one of the electric wires represented by the line 104 for driving the stepping motor 98 of FIG. 9 in a clockwise or counterclockwise direction for enlarging or descreasing the width of the gap 44. When the signal on line 148 is of zero value, no clock pulses are transmitted by the gating circuit 142. Thereby, the actual gap width is made equal to the required gap width to produce the selected speed of the slow wave about the inner slow wave structure 40.

Figure 12:
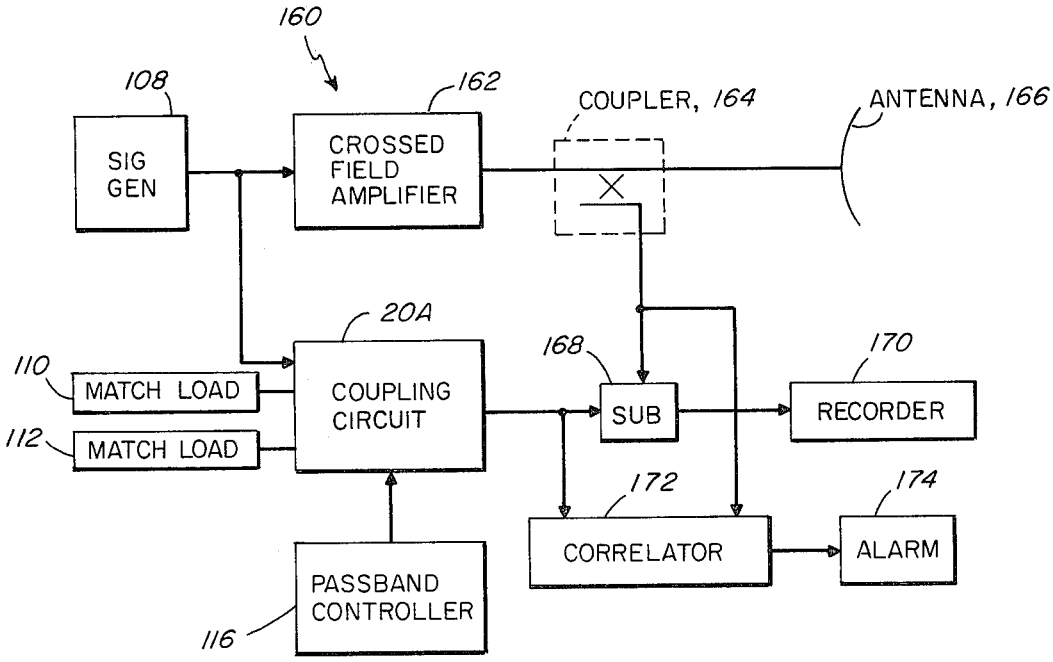
FIG. 12 shows the use of the coupling circuit of FIG. 1 in a radar system or communication system for monitoring the output signal of a crossed field amplifier.
Figure 13:
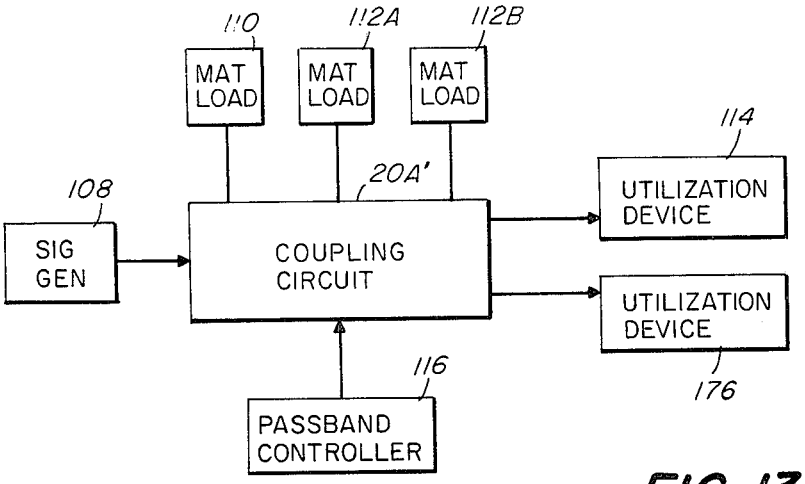
FIG. 13 shows the use of the coupling circuit of FIGS. 1 and 5 for coupling a signal to a plurality of utilization devices.

Referring now to FIGS. 12 and 13 there are seen systems demonstrating the use of the coupling circuits 20 and 20A. Assuming the more general case wherein it may be desirable to select a specific pass band of the coupling circuit, the coupling circuit 20A is shown. FIG. 12 shows a transmitter 160 for use in a radar or communication system. The transmitter 160 comprises the aforementioned signal generator 108, the coupling circuit 20A with the matched loads 110 and 112 connected thereto, and the controller 110. The transmitter 160 further comprises a crossed field amplifier 162 of conventional design and having a power gain of 10 dB, a 40 dB coupler 164, an antenna 166, a subtractor 168, a recorder 170, a correlator 172 and an alarm 174.

The coupler 164 provides a sample of the output signal of the amplifier 162 to the subtractor 168. In view of the 30 dB attenuation of the coupling circuit 20A and the 10 dB amplification of the amplifier 162, the 40 dB coupling of the coupler 64 produces a reference signal having an amplitude substantially equal to that at the output of the coupling circuit 20A.

In operation, therefor, a signal produced by the generator 108 is amplified by the amplifier 162 and coupled via the coupler 164 to the antenna 166 for radiation therefrom. The pass band of the coupling circuit 20A is made equal to the pass band of the amplifier 162 by the controller 116. The gain of the amplifier 162 is monitored as a function of time by the recorder 170 which provides a record of the difference signal produced by the subtractor 168, the difference signal being the difference between the signals of the amplifier 162 and the circuit 20A. Thus, with aging of the amplifier 162, an effect of such aging being typically a loss of emissivity of electrons from the cathode thereof, the recorder 170 shows this loss of gain. Thereby, the time for replacement of the amplifier 162 can be readily observed. In additiona, and by way of example in the use of the circuit 20A, the two input signals applied to the subtractor 168 may also be applied to a correlator 172. In the event that the frequency response of the amplifier 162 varies relative to the fixed response of the circuit 20A, signal pulses produced by the generator 108 may experience distortion which results in a loss of correlation between the two signals applied to the correlator 172. The alarm 174, being responsive to the magnitude of the correlation, sounds an alarm when the correlation falls off excessively, this indicating excessive distortion in the amplifier 162.

With reference to FIG. 13, the coupling circuit 20A is understood to incorporate the bifurcated outer slow wave structure 28 of FIG. 5 and, accordingly, has been further identified in FIG. 13 by the legend 20A'. In addition to the utilization device 114, a second utilization device 176 is employed. The utilization device 114 may be coupled to an end of one section of the slow wave structure 28A via a port such as the port 26 of FIG. 1 while the utilization device 176 is coupled via a similar port (not shown in FIG. 1) to the corresponding end of the other section of structure 28A. Similarly, matched loads 112A and 112B, analogous to the matched load 112 of FIG. 1 are coupled respectively to the remaining ends of the two sections of the structure 28A. In this way, a signal produced by the generator 108 is coupled to a plurality of utilization devices via the circuit 20A' while the controller 116 selects the pass band of the circuit 20A'.

Figure 1:
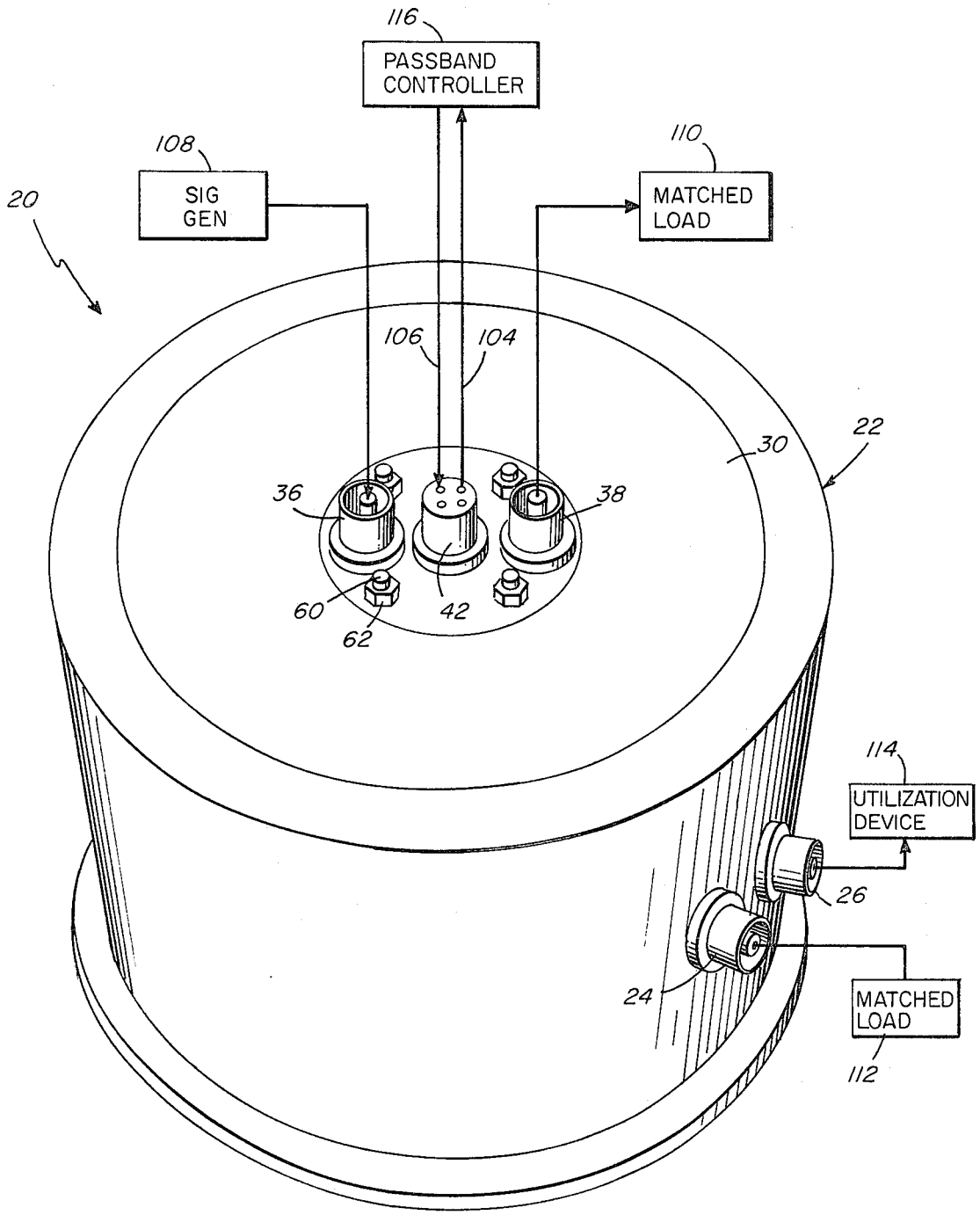
FIG. 1 shows a perspective view of a coupling circuit employing slow wave structures in accordance with the invention.
Figure 2:
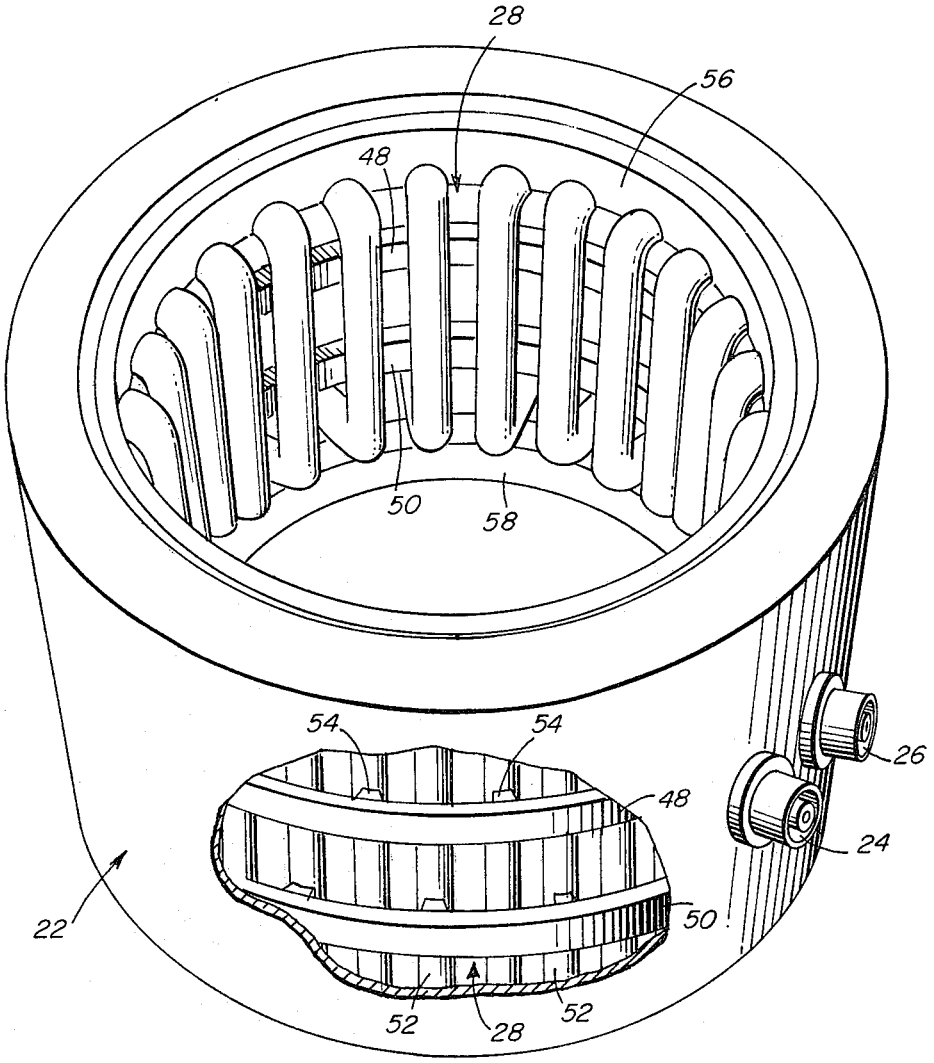
FIG. 2 shows a perspective view of a housing of FIG. 1, the housing being partially cut away to show an outer slow wave structure comprising a pair of conductors which are periodically loaded by a set of bars.
Figure 3:
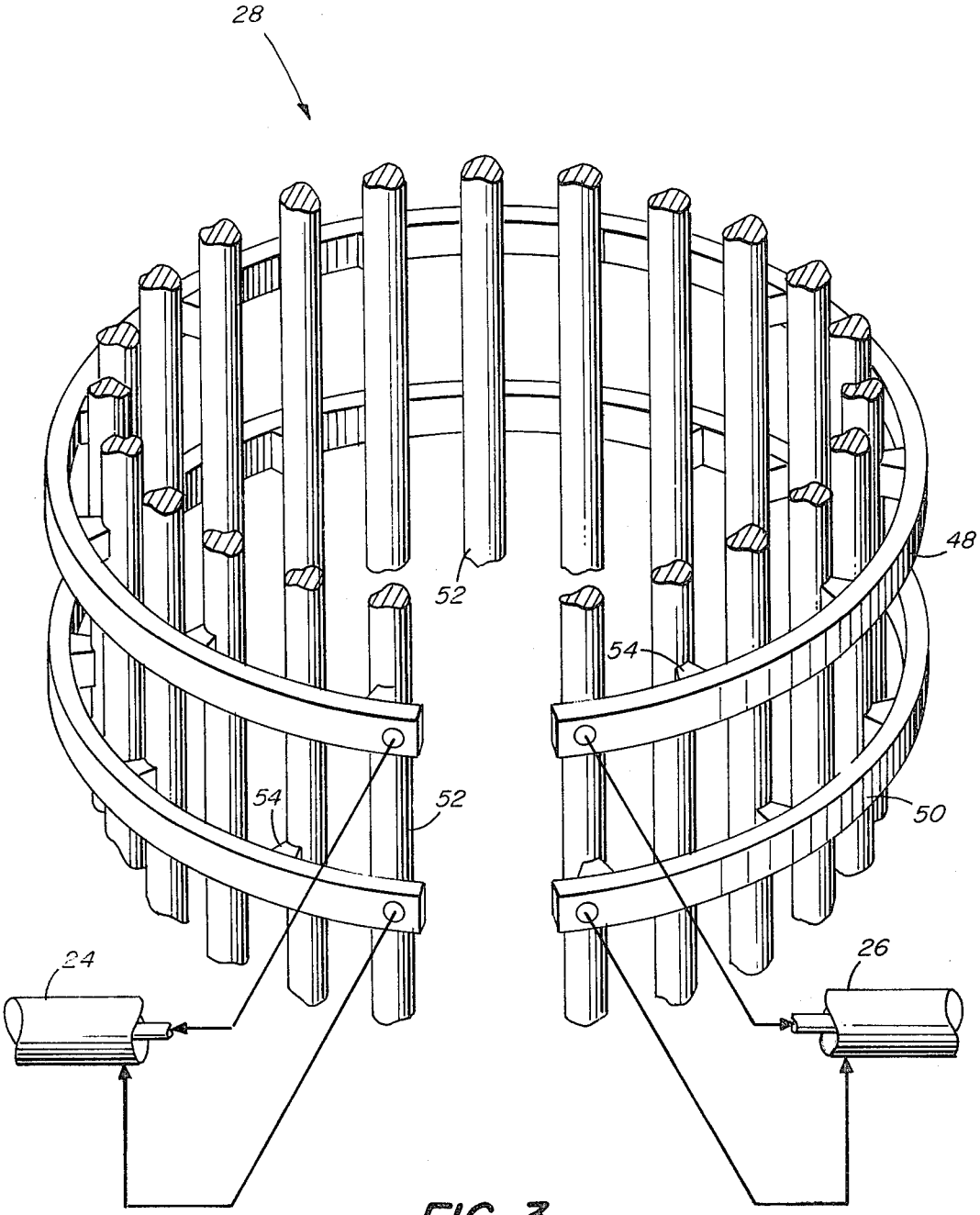
FIG. 3 shows an isometric view of the outer slow wave structure of FIG. 2 with electrical connections from the input and output terminals thereof to coaxial cables being shown schematically.
Figure 14:
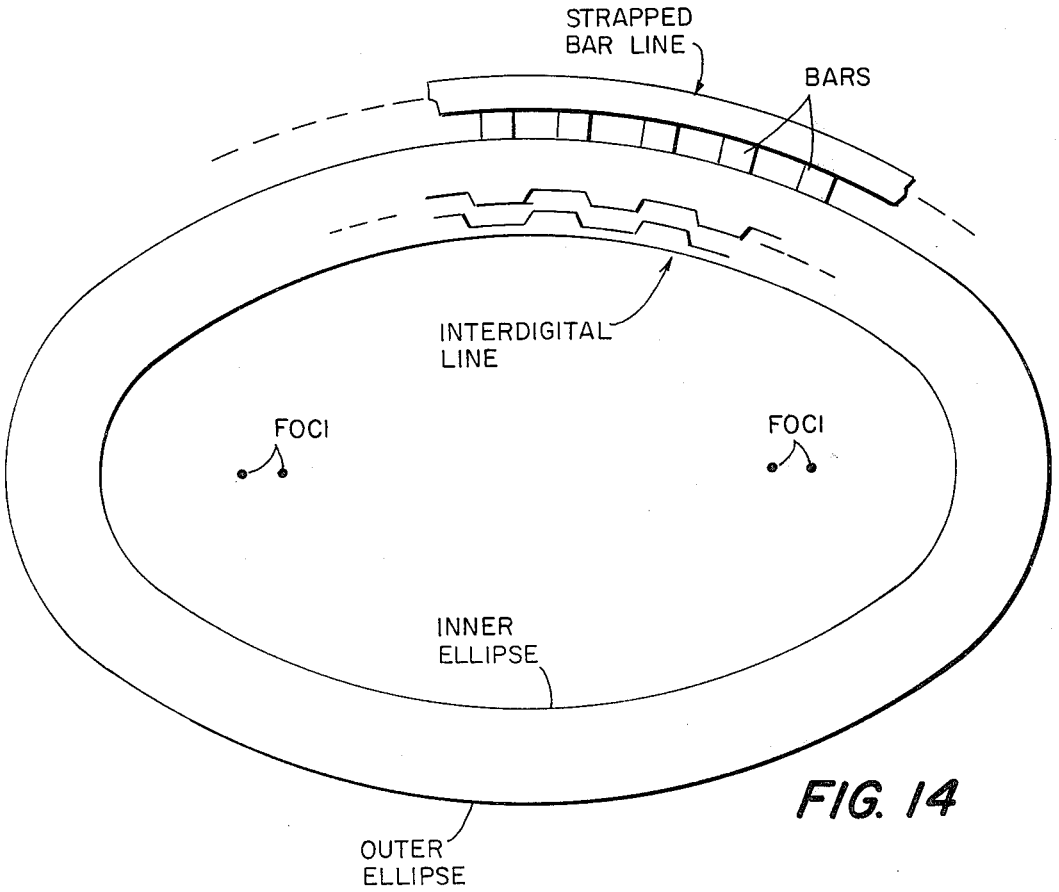
FIG. 14 shows a diagrammatic view of a modification of outer slow wave structures have ellipsoidal cross sections.

Referring now to FIG. 14, there is shown schematically a plan view of a modification of the coupling circuit 20 of FIG. 1 wherein the outer slow wave structure 28, a strapped bar line, and the inner slow wave structure 40, an interdigital line, are provided with elliptical cylindrical forms rather than the circular cylindrical forms of the circuit 20 of FIG. 1. In the embodiment of FIG. 14, there are two cylindrical axes for each elliptical cylinder corresponding to the foci of each ellipse. All four axes are parallel. The two sets of foci provide for a uniform spacing between the two ellipses for coupling electromagnetic energy from one slow wave structure to the other slow wave structure.

It is understood that the above-described embodiments of the invention are illustrative only and that modifications thereof may occur to those skilled in the art. Accordingly, it is desired that this invention is not to be limited to the embodiments disclosed herein but is to be limited only as defined by the appended claims.

What is claimed is:

1. A coupling circuit comprising:

an outer slow wave structure;

an inner slow wave structure;

said outer slow wave structure having a generally cylindrical form, and said inner slow wave structure having a generally cylindrical form;

said outer slow wave structure enclosing at least a portion of said inner slow wave structure and being disposed adjacent the inner slow wave structure for directly coupling radiant energy from one of said structures to the other one of said structures, a cylindrical axis of said outer slow wave structure being parallel to a cylindrical axis of said inner slow wave structure;

said inner slow wave structure being configured to support a slow wave having a phase velocity of a first magnitude, and said outer slow wave structure being configured to support a slow wave having a phase velocity of a second magnitude, said first and second magnitudes being proportional respectively to the circumference of said inner slow wave structure and the circumference of said outer slow wave structure to provide synchronization of a wavefront on said inner slow wave structure with a wavefront on said outer slow wave structure; and means for applying radiant energy to one of said slow wave structures and means for extracting radiant energy from a second one of the slow wave structures.

2. A coupling circuit according to claim 1 wherein said outer slow wave structure has the form of a strapped bar line.

3. A coupling circuit according to claim 1 wherein said inner slow wave structure has the form of an interdigital line.

4. A coupling circuit according to claim 3 further comprising means coupled to said inner slow wave structure for varying the spacing between members of said interdigital line for varying a speed of propagation of a wavefront about said inner slow wave structure.

5. A coupling circuit according to claim 4 wherein said outer slow wave structure is bifurcated to provide a plurality of electrically isolated input ports and a plurality of electrically isolated output ports, electromagnetic energy being coupled from said inner slow wave structure to individual sections of said outer slow wave structure.

6. An electromagnetic circuit comprising:

a plurality of slow wave structures, a first of said structures being mounted adjacent a second of said structures for directly coupling radiant energy from one of said structures to a second of said structures;

means for applying radiant energy to one of said structures and means for extracting radiant energy from a second of said structures;

each of said structures being terminated in its characteristics impedance; and wherein one of said structures is configured to provide a speed of propagation of a wavefront of said radiant energy in step with a wavefront of radiant energy propagating around a second of said structures.

7. A circuit according to claim 6 wherein a second and a third of said structures is positioned adjacent a first one of said structures.

8. A circuit according to claim 6 wherein a first one of said structures is in the form of an interdigital line and a second of said structures is in the form of strapped bar line.

9. A circuit for coupling radiant energy comprising:

a plurality of slow wave structures mounted concentrically about a common axis, each of said slow wave structures having a generally cylindrical form, a first one of such slow wave structures being mounted adjacent a second one of said slow wave structures for directly coupling electromagnetic energy from one of said structures to a second one of said structures;

means for applying electromagnetic energy to one of said structures and means for extracting electromagnetic energy from said second one of such structures;

one of said slow wave structures being configured to provide a rate of rotation about said axis to a wavefront on said one slow wave structure which is equal to the rate of rotation of a wavefront on said second slow wave structure.

10. A circuit according to claim 9 wherein each of said slow wave structures is terminated in its characteristic impedance to inhibit the formation of standing waves on the respective slow wave structures.

11. A coupling circuit comprising:

(a) an outer slow wave structure having a generally cylindrical form;

(b) an inner slow wave structure having a generally cylindrical form, said inner slow wave structure and said outer slow wave structure being mounted adjacent each other for directly coupling electromagnetic energy from a first one of said structures to a second one of said structures, said inner slow wave structure being configured to support a slow wave having a phase velocity related to the circumference of said inner slow wave structure and said outer slow wave structure being configured to support a slow wave having a phase velocity related to the circumference of said outer slow wave structure to provide a wavefront on said inner slow wave structure having a phase velocity related to the phase velocity of a wavefront on said outer slow wave structure;

(c) means for applying electromagnetic energy to a first one of said slow wave structures; and (d) means for extracting electromagnetic energy from a second one of said slow wave structures.

12. A coupling circuit comprising:

an outer slow wave structure;

an inner slow wave structure;

said outer slow wave structure having a generally cylindrical form, and said inner slow wave structure having a generally cylindrical form;

said outer slow wave structure enclosing at least a portion of said inner slow wave structure and being disposed adjacent the inner slow wave structure for coupling radiant energy from one of said structures to the other one of said structures, a cylindrical axis of said outer slow wave structure being parallel to a cylindrical axis of said inner slow wave structure;

said inner slow wave structure being configured to support a slow wave having a circumferential phase velocity of a first magnitude less than the speed of light, and said outer slow wave structure being configured to support a slow wave having a circumferential phase velocity of a second magnitude less than the speed of light, said first and second magnitudes being proportional respectively to the circumference of said inner slow wave structure and the circumference of said outer slow wave structure to provide synchronization of a circumferential wavefront on said inner slow wave structure with a circumferential wavefront on said outer slow wave structure; and means for applying radiant energy to one of said slow wave structures and means for extracting radiant energy from a second one of the slow wave structures.

13. A coupling circuit according to claim 12 wherein said outer slow wave structure has the form of a strapped bar line.

14. A coupling circuit according to claim 12 wherein said inner slow wave structure has the form of an interdigital line.

15. A coupling circuit according to claim 14 further comprising means coupled to said inner slow wave structure for varying the spacing between members of said interdigital line for varying a speed of propagation of a circumferential wavefront about said inner slow wave structure.

16. A coupling circuit according to claim 15 wherein said outer slow wave structure is bifurcated to provide a plurality of electrically isolated input ports and a plurality of electrically isolated output ports, electromagnetic energy being coupled from said inner slow wave structure to individual sections of said outer slow wave structure.

17. An electromagnetic circuit comprising:

a plurality of slow wave structures, a first of said structures being mounted adjacent a second of said structures for coupling radiant energy from one of said structures to a second of said structures;

means for applying radiant energy to one of said structures and means for extracting radiant energy from a second of said structures;

each of said structures being terminated in its characteristic impedance; and wherein one of said structures is configured to provide a speed less than that of light of circumferential propagation of a wavefront of said radiant energy in step with a wavefront of radiant energy circumferentially propagating around a second of said structures.

18. A circuit according to claim 17 wherein a second and a third of said structures is positioned adjacent a first one of said structures.

19. A circuit according to claim 17 wherein a first one of said structures is in the form of an interdigital line and a second of said structures is in the form of strapped bar line.

20. A circuit for coupling radiant energy comprising:

a plurality of slow wave structures mounted concentrically about a common axis, each of said slow wave structures having a generally cylindrical form, a first one of such slow wave structures being mounted adjacent a second one of said slow wave structures for coupling circumferentially propagating electromagnetic energy from one of said structures to a second one of said structures;

means for applying electromagnetic energy to one of said structures and means for extracting electromagnetic energy from said second one of such structures;

one of said slow wave structures being configured to provide a rate of circumferential rotation about said axis to a wavefront on said one slow wave structure which is equal to the rate of circumferential rotation of a wavefront on said second slow wave structure.

21. A circuit according to claim 20 wherein each of said slow wave structures is terminated in its characteristic impedance to inhibit the formation of standing waves on the respective slow wave structures.

22. A coupling circuit comprising:

(a) an outer slow wave structure having a generally cylindrical form;

(b) an inner slow wave structure having a generally cylindrical form, said inner slow wave structure and said outer slow wave structure being mounted adjacent each other for coupling electromagnetic energy from a first one of said structures to a second one of said structures, said inner slow wave structure being configured to support a slow wave having a circumferential phase velocity related to the circumference of said inner slow wave structure and said outer slow wave structure being configured to support a slow wave having a circumferential phase velocity related to the circumference of said outer slow wave structure to provide a wavefront on said inner slow wave structure having a phase velocity related to the phase velocity of a wavefront on said outer slow wave structure;

(c) means for applying electromagnetic energy to a first one of said slow wave structures; and (d) means for extracting electromagnetic energy from a second one of said slow wave structures.

* * * * *